US007271683B2

(12) United States Patent
Hayes et al.

(10) Patent No.: US 7,271,683 B2
(45) Date of Patent: Sep. 18, 2007

(54) ELECTROMAGNETIC SWITCH ELEMENT

(75) Inventors: David Hayes, Winchester (GB); Richard Brooke Keeton, Beaulieu (GB)

(73) Assignee: Plasma Antennas Limited, Oxfordshire (GB)

( * ) Notice: Subject to any disclaimer, the term of this patent is extended or adjusted under 35 U.S.C. 154(b) by 38 days.

(21) Appl. No.: 10/532,445

(22) PCT Filed: Oct. 20, 2003

(86) PCT No.: PCT/GB03/04523

§ 371 (c)(1),
(2), (4) Date: Apr. 22, 2005

(87) PCT Pub. No.: WO2004/038850

PCT Pub. Date: May 6, 2004

(65) Prior Publication Data

US 2005/0270126 A1 Dec. 8, 2005

(30) Foreign Application Priority Data

Oct. 23, 2002 (GB) ..... 0224724.5

(51) Int. Cl.
*H01P 1/10* (2006.01)
*H01P 5/12* (2006.01)

(52) U.S. Cl. ..... 333/101; 333/105; 333/262

(58) Field of Classification Search ..... 333/101, 333/105, 262; 200/181
See application file for complete search history.

(56) References Cited

U.S. PATENT DOCUMENTS 2,896,177 A 7/1959 Wilson ..... 333/33
3,949,328 A 4/1976 Levaillant ..... 333/81 B
5,268,696 A * 12/1993 Buck et al. ..... 342/372
6,143,997 A * 11/2000 Feng et al. ..... 200/181
6,373,349 B2 * 4/2002 Gilbert ..... 333/126

FOREIGN PATENT DOCUMENTS

DE A3 608 451 9/1987
JP 06 140811 A 5/1994

OTHER PUBLICATIONS

Mazotta, J. et al.: "Reconfigurable transmission-type beamformer", Microwave Symposium Digest, 2000 IEEE MTT-S International Boston, MA USA Jun. 11-16, 2000, Piscataway, NJ, USA, IEEE, US, Jun. 11, 2000, pp. 585-588.

Tangonan, G. et al.: "Microwave photonic applications of MEMS technology" Microwave Photonics, 1999. MWP '99. International Topical Meeting on Melbourne, VIC., Australia Nov. 17-19, 1999, Piscataway, NJ, USA, IEEE, US, Nov. 17, 1999, pp. 109-112.

Elamaran, B. et al.: "A beam-steerer using reconfigurable PBG ground plane" Microwave Symposium Digest. 2000 IEEE MTT-S International Boston, MA, USA Jun. 11-16, 2000, Piscataway, NJ, USA, IEEE, US, Jun. 11, 2000, pp. 835-838.

Veihl, C. et al.: "Reconfigurable aperture decade bandwidth array" IEEE Antennas and Propagation Society International Symposium—Digest, vol. 1, Jul. 16-21, 2000, pp. 314-317.

* cited by examiner

*Primary Examiner*—Dean Takaoka
(74) *Attorney, Agent, or Firm*—Iandiorio & Teska

(57) ABSTRACT

An electromagnetic switch element that through electromechanical actuation is able to be used to influence the propagation of an electromagnetic signal within a guiding medium. An electromagnetic switch element that is activated by displacement of conducting elements, the displacement being forced through electrostatic, electric field, magnetic field, thermal or other means.

8 Claims, 7 Drawing Sheets

EM Reflective Switch (R>>T+A)

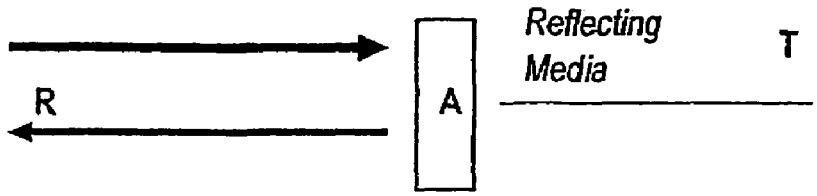
Figure 1 EM Reflective Switch (R>>T+A)
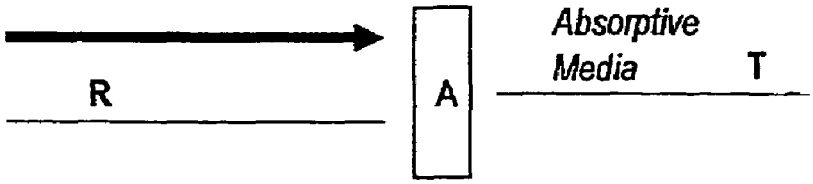
Figure 2 EM Absorptive Switch (A>>R+T)
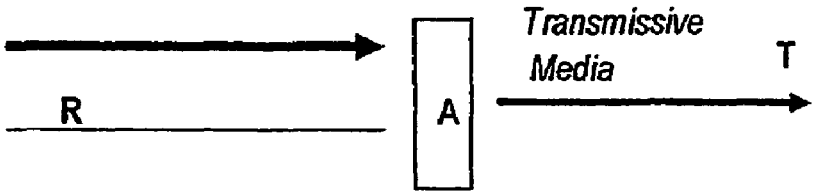
Figure 3 EM Transmissive Switch (T>>R+A)

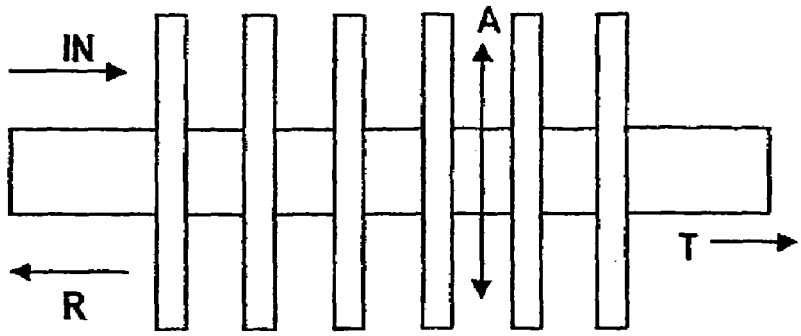
Figure 4 EBG Transmission Line
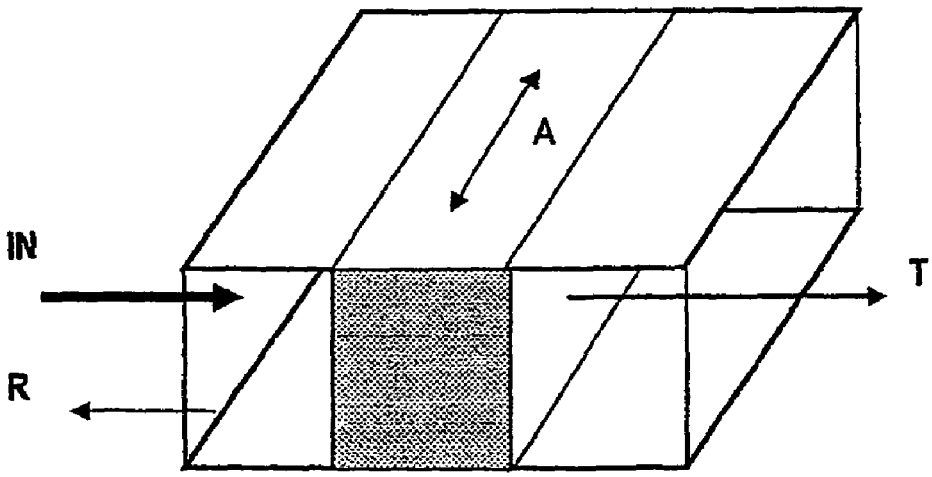
Figure 5 Parallel Plate Wave Guide

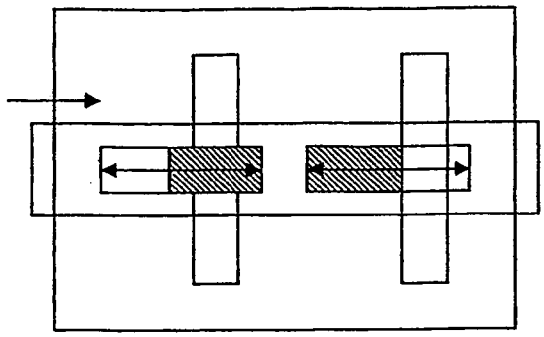
Figure 6 Surface Electrostatic EBG Switch
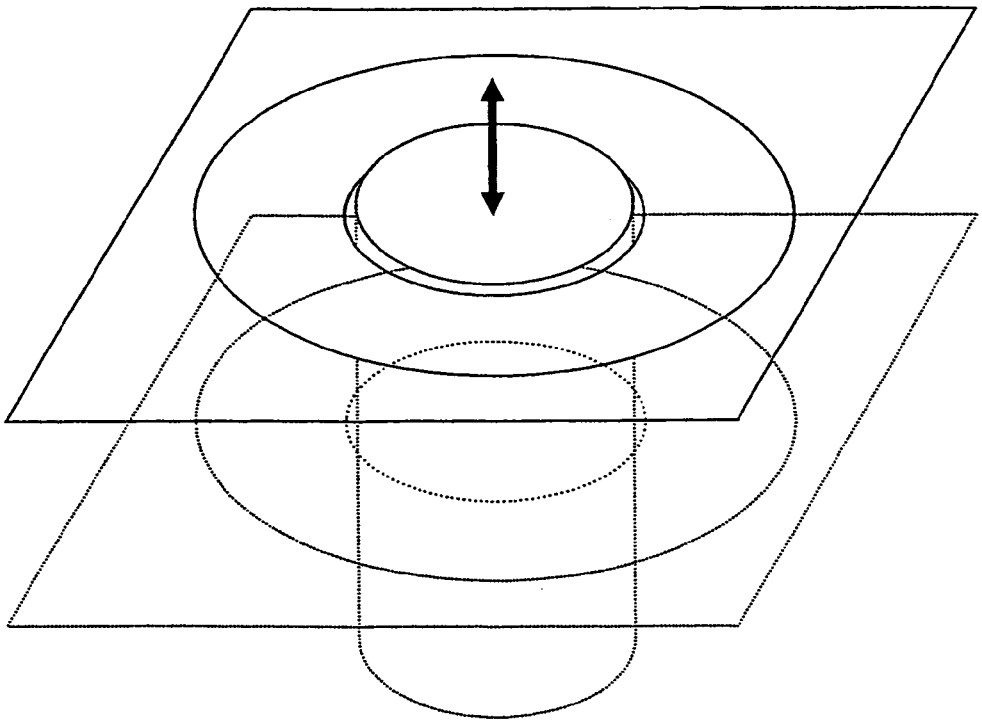
Figure 7 Through Thickness Electromagnetic Switch

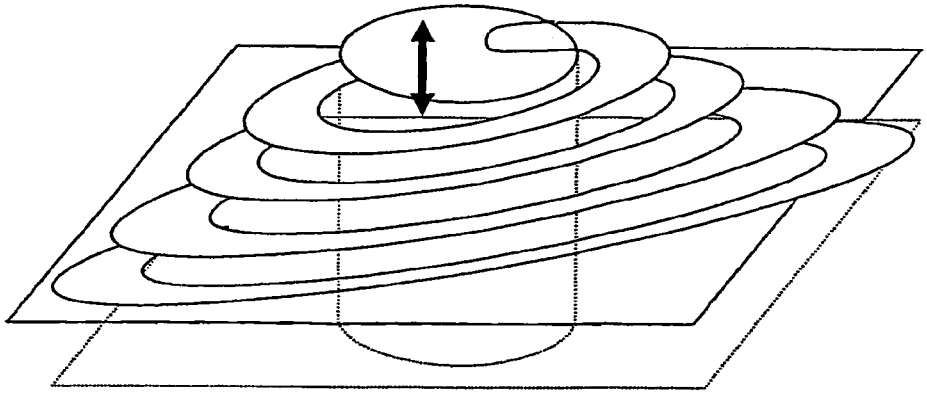
Figure 8 Mu Metal Switch
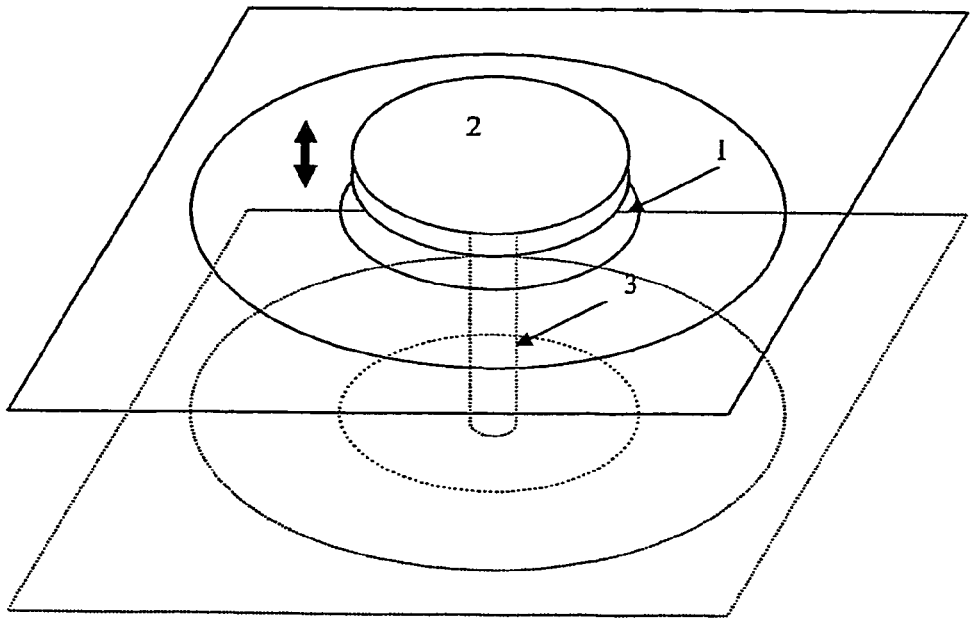
Figure 9 A Through Thickness Fluidic Switch

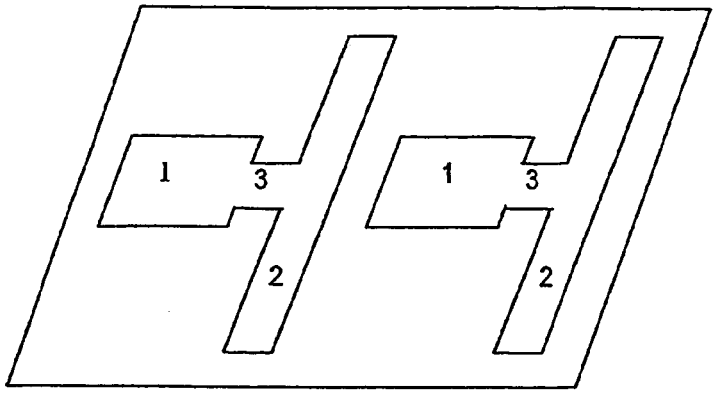
Figure 10 A Surface Fluidic Switch
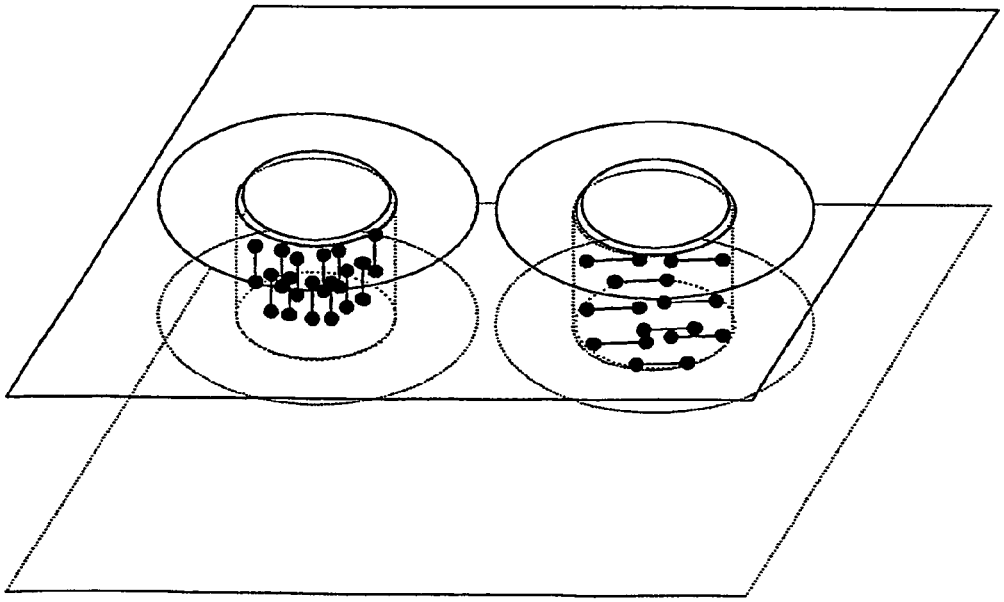
Figure 11 Through-thickness Molecular Switch

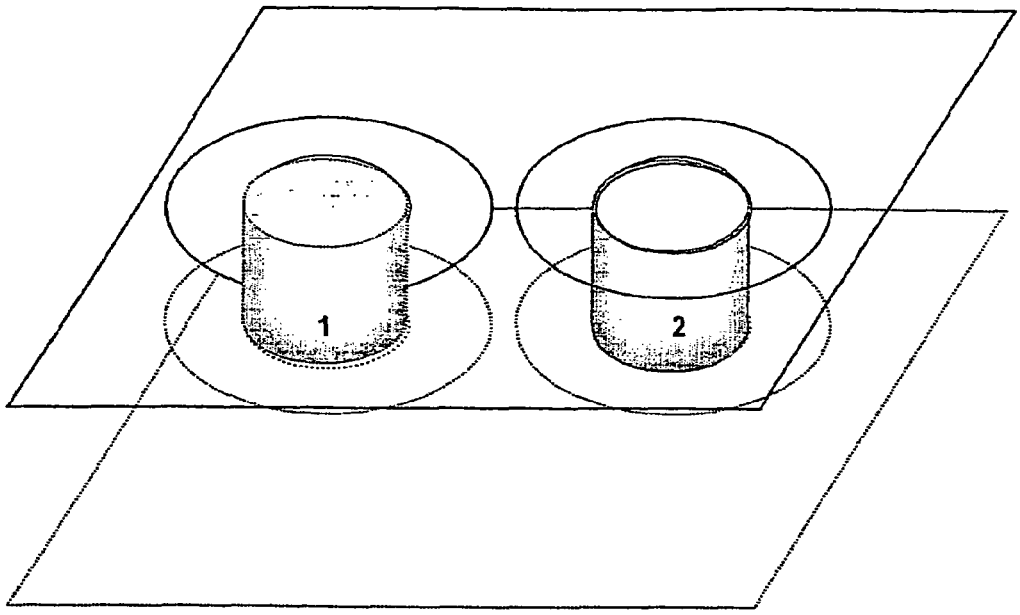
Figure 12 Through-thickness Powder Switch
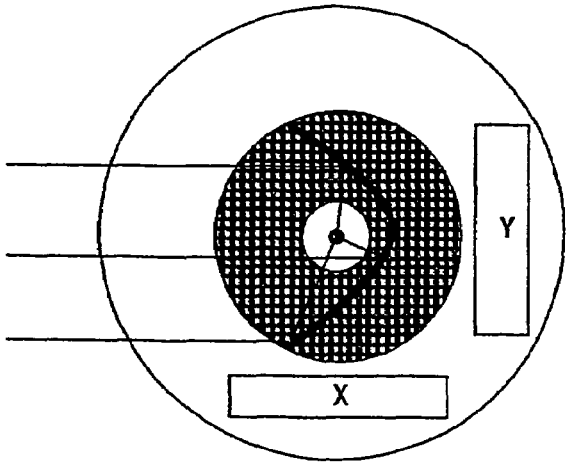
Figure 13 Lens/Reflector through-thickness MEMS Array

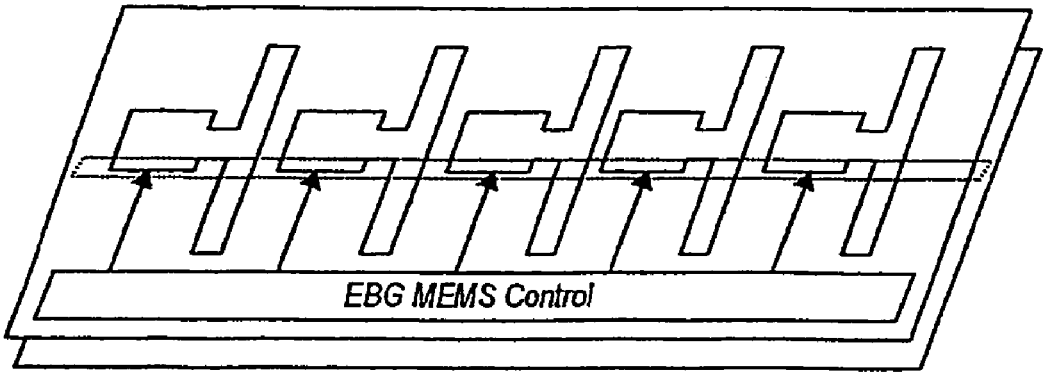
Figure 14 MEMS EBG Array

ELECTROMAGNETIC SWITCH ELEMENT

FIELD OF THE INVENTION

This invention relates to an electromagnetic switch element that is electromechanical in nature. The electromagnetic switch element may be used selectively to reflect or absorb or otherwise influence an incident electromagnetic radiation. The electromagnetic switch element may be of such a size as to readily be incorporated into microstrip and other known media used to guide and confine the electromagnetic radiation throughout a broad microwave spectrum. The invention may be especially applicable to millimetric or terahertz technologies within the fields of telecommunications, radar, sensing and dynamic tracking.

BACKGROUND OF THE INVENTION

Electromagnetic radiation may be confined and directed by means of known transmission line structures such as those generally described as microstrip, or by means of waveguides. Switches and directors of the electromagnetic radiation may be configured by the placement of elements within the plane of a propagated electric field. The magnitude of the effect of the said elements upon the propagated signal is dependent upon the physical extent and position of the element and its degree of electrical conductivity.

DESCRIPTION OF THE PRIOR ART

Our Patent Application No. PCT/GB02/01925 entitled "An Electromagnetic Delay Line with Photonic Control" describes how the incorporation of distributed switches along the propagation path of an electromagnetic microstrip structure may be used to control the time delay of a signal through that structure. The switches are made of semiconductor media subject to electrical carrier stimulation through optical illumination or otherwise through electrical carrier injection by electrical means.

Our Patent Application No. PCT/GB01/02813 (WO 02/01671) entitled "An Antenna" describes a microwave antenna comprising essentially parallel conducting plates that enclose an intrinsic semiconductor medium. A pattern of distributed transversal conducting elements is used to conduct the directivity of the antenna. Filaments are produced by optical or electrical stimulation in selected regions of the semiconductor medium.

In the above two patent applications, electromagnetic radiation is affected by the extent and conductivity of the filaments, or carriers, otherwise described as a plasma.

A BRIEF DESCRIPTION OF THE INVENTION

It is an aim of the present invention to provide an electromagnetic switch element that may readily be incorporated into known electromagnetic transmission means such as planar micro strip systems and waveguide systems.

Accordingly, in one non-limiting embodiment of the present invention there is provided an electromagnetic switch element that through electromechanical actuation is able to be used to influence the propagation of an electromagnetic signal within a guiding medium.

The guiding medium may be a planar guiding medium. The guiding medium may be a waveguide.

The guiding medium may be made of a semiconductoral material.

In another nonlimiting embodiment of the present invention there is provided an electromagnetic switch element that is activated by displacement of conducting elements, the displacement being forced through electrostatic, electric field, magnetic field, thermal or other means.

The conducting elements may be in the form of polymers powders or liquid suspensions.

The electromagnetic switch element of the present invention may comprise:

(a) microwave guidance means;

(b) at least one conductive element that is able to be selectively introduced into the guidance means such as to affect the propagation of electromagnetic energy within the guidance means; and (c) at least one element of controllable reflectivity that may be used to affect the spatial distribution of the electromagnetic energy by absorption of energy.

The present invention enables electromechanical influence of an electromagnetic signal through the activation of small mechanical reflectors and absorbers. The apparatus of the present invention may be designed by calculation of the required geometrical disposition of the electromagnetic switch elements and the reflective or absorptive effect of those elements in order to control propagated electromagentic signal characteristics such for example as power and spatial distribution. The invention may be applied to free-space direction of telecommunications or other microwave traffic. The invention may be applied to active antennas which may be used in tracking applications such for example as on-board vehicular data handling and satellite communications. The present invention may be applicable throughout the exploited range of microwave frequencies, and it may be extended through miniaturisation to teraherit regions in excess of 100 GHz frequencies.

The electromagnetic switch element may be such that the microwave guidance means are parallel conductive plates.

The invention may be regarded as a device that may controllably exhibit the properties of high conductivity through to high resistivity. A plurality of the devices may be arranged to replicate the effect of a distributed plane or contour of reflectors. Furthermore, partially reflective elements may be used advantageously to modify the spatial distribution of energy within the propagated signal.

The invention may be regarded as being based upon the realisation that localised plasmas may be otherwise implemented in the form of conductive metallic elements. Various mechanical designs may be employed to illustrate typical mechanisms for controlling the physical extent and degree of influence of the conductive metallic elements.

The present invention may provide the following advantages.

Reduced power requirement.

Higher electromagnetic frequency limitation.

Lower added electromagnetic noise.

Lower temperature sensitivity.

Lower electromagnetic attenuation.

Enhanced precision of control.

The present invention also extends to a distributed array of the electromagnetic switch elements. The electromagnetic switch elements may be able to be controlled through associated logic devices.

The present invention also provides a miniaturised active electromagnetic antenna including at least one of the electromagnetic switch elements, or at least one of the distributed arrays.

The present invention also provides an active electromagnetic delay line including at least one of the electromagnetic switch elements, or at least one of the distributed arrays.

The antenna or the delay line may be designed by calculation of geometry and material properties to perform in specific applications relating to telecommunications, radar, scanning, inspection, and other forms of imaging.

BRIEF DESCRIPTION OF THE DRAWINGS

Embodiments of the invention will now be described solely by way of example and with reference to the accompanying drawings in which:

FIG. 1 shows an electromagnetic switch element used to reflect a greater proportion of incident energy when activated;

FIG. 2 shows an electromagnetic switch element used to absorb a greater proportion of incident energy when activated;

FIG. 3 shows an electromagnetic switch element used to allow transmission of a greater proportion of incident energy when activated;

FIG. 4 shows electromagnetic switch elements in the distributed form of a transmission line, with the switches being such that they be used to control reflection, transmission and time delay of the transmitted energy;

FIG. 5 shows an electromagnetic switch element within a waveguide medium, the electromagnetic switch element being such that it may be used to absorb, reflect or transmit proportions of electromagnetic energy;

FIG. 6 shows a pair of surface electromagnetic switch elements operated by a sliding metallic element which may be forced to move by electrostatic or magnetic means;

FIG. 7 shows an electromagnetic switch element operated through a waveguiding medium, the switching element being a magnetised element that may be induced to move through an applied magnetic field;

FIG. 8 shows an electromagnetic switch element operated through a wave guiding medium, the switching element being a mechanical element that may be induced to change shape when subject to an electrical current;

FIG. 9 shows an electromagnetic switch element operated through a wave guiding medium, the switching element being a fluidic medium that may be induced to move through the switch by pressure from a piezoelectric or other mechanical device;

FIG. 10 shows a planar electromagnetic switch element, the switching element being a fluidic medium that may be induced to move through the switch by pressure from a piezoelectric or other mechanical device;

FIG. 11 shows an electromagnetic switch element operated through a wave guiding medium, the switching element being a fluidic medium containing a molecular suspension that may be induced to change alignment of suspended molecules through an applied electric or magnetic field;

FIG. 12 shows an electromagnetic switch element operated through a wave guiding medium, the switching element being a powder medium that may be induced to move within the switch by application of electric charge;

FIG. 13 shows an array of electromagnet switch elements that may be selectively addressed in order to replicate the effects of a distributed reflector; and FIG. 14 shows a linear array of electromagnetic switch elements that may be selectively addressed in order to control propagation characteristics of a planar transmission line.

DETAILS DESCRIPTION OF THE DRAWINGS

Referring to FIG. 1, there is shown how a reflective switch plays a crucial role in directing microwaves within an antenna or basic microwave device. Typical reflective devices are electrically biased PIN diodes (P-doped region, intrinsic region, N-doped region diodes) in transmission lines, or mechanically positioned surfaces in waveguides.

In the present invention, a variety of microelectro-mechanical systems (MEMS) are used by way of illustration to perform the same functional operations in a lens/plasma reflector antenna (see the above mentioned Patent Application No. PCT/GB02/01925) and plasma control electromagnetic band gap (EBG) time delays (see the above mentioned Patent Application No. PCT/GB01/02813) as the plasma generating PIN devices. Potential advantages are as follows:

Lower quiescent power requirements.
Higher frequency operation.
Lower noise.
Wider temperature operation.
Lower loss.
Finer control.

The choice of reflecting media depends largely on Snell's and Fresnel's Laws, which relate to the complex permitivity of the media and the angle of incidence, to predict the relative strengths of the reflected, the absorbed and the transmitted signal, together with their angles of reflection and refraction. The complex permitivity is given for any material by the plasma equation. The essential difference between this and the above mentioned earlier two patent applications is that the switching media is mechanically moved rather than generated locally by optical, magnetic or electrical stimulation of a semi-conductor of a ferro-electric material.

The approach has the above advantages that it is not constrained to semiconductor materials. The switching media could be either a metal or a dielectric, depending on the geometry of the device. The switching media could be used in either liquid, solid or gaseous forms.

Referring now to FIG. 2, there is shown an electromagnetic absorptive switch element which is the same as the reflective switch shown in FIG. 1 except that the media is absorptive to electromagnetic waves. Multiple switch elements may be arrayed to permit greater absorption. The absorptive switch element may be used to control attenuation and reduce unwanted signals. In antenna design, this is an important function in controlling aperture tapers, which in turn may reduce sidelobes and increase directivity.

Referring now to FIG. 3, there is shown an electromagnetic transmissive switch element which may be thought of as allowing efficient electromagnetic transmission. The electromagnetic transmissive switch element may therefore act as a guide for an electromagnetic wave with minimum absorptive or reflective losses. In fact, all the three switch elements shown in FIGS. 1, 2 and 3 essentially change the relative balance between absorption, reflection and transmission, with the dominance of one effect over another defining the type of switch. By replacing one medium with another, for example a dielectric with a metal, the switch element changes its state. Commonly, air (or free space) may be one of the media.

Referring now to FIG. 4, there is shown an electromagnetic band gap transmission line. By opening and closing holes in the ground plane in the transmission line, the transmission line may become reflective, transmissive or absorptive in a very controlled way. The speed of propagation down the transmission line can also be controlled.

Later Figures illustrate how different media may be moved in and out of the holes in order to provide highly controlled devices that form useful electromagnetic devices that can be incorporated into low power antennas and other microwave devices.

Referring now to FIG. 5, there is shown a parallel plate waveguide containing a control space which may be filled with different media in order to allow variable controllable amounts of absorption, reflection and transmission. In the case of a lens/reflector antenna, the reflective mirror is generated from plasma. The reflective, absorptive or transmissive material is changed or substituted by mechanical movement.

Referring now to FIG. 6, there is shown an EBG device where the holes in the metal ground plane are opened and closed by moving a sliding metal shaft under electrostatic forces. The metal shaft may have to be insulated and be able to support an induced distribution. Alternatively, electromagnetic forces may be used to move the metal shaft using a solenoid process.

FIG. 7 shows a central magnetic shaft that can be moved back and forth through the thickness of a parallel waveguide, under the influence of a magnetic force generated by surface solenoids. The central magnetic shaft can be composed of sectioned materials that have different dielectric properties. Thus, for example, an upper part of the central magnetic shaft may be made of absorbing material, and a lower part of the shaft may be made of reflecting material.

FIG. 8 shows a mu-metal spiral actuator which has a naturally flat shape. Under electrical heating, the flat spiral distorts to a conical spiral, which lifts the centre through the thickness of the shaft. When the heating current is removed, the spiral returns to its natural flat shape, thus depressing the shaft. The shaft can be made out of an absorbing, transmitting or reflecting material, or some combination thereof.

FIG. 9 shows a fluidic through thickness switch element. In FIG. 9, there is shown a large reservoir 1 of conducting fluid which can be moved into a capillary tube 3 by compressing the reservoir 1 using a piezoelectric or other electromechanical device 2. The large reservoir 1 allows a hydraulic effect to be implemented, where the fine capillary tube 3 can quickly be filled by a small motion of the contracting reservoir 1.

FIG. 10 shows two surface fluidic switches where a fluidic pumping chamber 1 is connected to a secondary chamber 2 by channel 3 which sits above a gap in an EBG structure. By forcing conducting liquid into the region 2, the band gap may be closed. For clarity, the transmission line has been omitted from FIG. 10. The reduction in volume of the chamber 1 may be achieved using either a piezoelectric or an electromechanical device (not shown) closely located to the fluidic pumping chamber 1. By increasing the volume of the fluidic pumping chamber 1, the liquid may be extracted from the secondary chamber 2. The viscosity and surface tension of the conducting liquid will be chosen such that the conducting liquid remains cohesive and does not disperse within the fluidic pumping chamber 1. Micro-pores may be introduced in order to allow air to escape during exchange of liquid between the chambers, so as to allow the action to take place but these pores will be sufficiently fine to prevent liquid passing.

FIG. 11 shows two molecular switch elements in their different states. By way of example only, the molecules are shown in suspension, aligned and at right angles to the upper and lower surfaces of the parallel plate waveguide. In their aligned state, the material will not conduct and will thus form a transmissive switch. In their opposite state, the material will conduct and the material and the switch will be reflective. In general, either a local electric or magnetic field will need to be applied to orientate the molecules correctly. Alteratively, a carbon loaded polymer may be put under strain to change its electrical resistance in order to achieve similar effects.

FIG. 12 shows a through-thickness powder switch element. In FIG. 12, a fine powder is contained in a chamber. When the chamber is discharged, the powder is freely distributed about the volume. When the chamber is charged, the particles are attracted to the surface of the chamber where they form a reflective column. Alteratively, a conducting or absorbing vapour may be sustained within the volume through heating. When the heating is removed, this allows the vapour to condense, leaving the chamber in a transmissive state. Alternatively, the powder may be moved from the upper and lower surfaces to the sidewalls of the chamber by charging the surfaces, thus changing the transmissive properties of the switch. A similar configuration in reverse may be used to close holes in a ground plane.

FIG. 13 shows a lens/reflector through-thickness MEMS array. More specifically, FIG. 13 shows an array of through-thickness MEMS devices with x, y addressing. A curved reflector has been created within a flat circular lens by setting the MEMS switches appropriately. The two flat surfaces of the lens have been metallised to create a parallel plate waveguide. The reflector can be moved around the centre feed to provide a controllable beam, by adjusting a pattern to match the required shape of the reflector. If the MEMS switches are designed to latch, then the control circuitry is simplified. If the stable state can be maintained for zero or little energy, the device becomes a very low power device.

FIG. 14 shows a MEMS EBG array, where a five band gap structure has been arranged above a micro-strip transmission line. Each of the EBG surface MEMS devices can be controlled individually in order to allow different degrees of closure of the ground plane. By varying the degree and pattern of closure, the speed of transmission along the line can be controlled.

System Overview

It will be appreciated from the description of the invention with reference to the accompanying drawings, that the present invention is able to controllably attenuate, direct or otherwise affect electromagnetic signals within a guidance medium. The present invention is especially directed at miniaturised monolithic antenna structures, applicable throughout the presently exploited microwave spectrum and extendable by means of so-called nano technology to frequencies in excess of 100 GHz.

It is also to be appreciated that the mechanical means to introduce and control the active media as described above with reference to the accompanying drawings have been given by way of example only and that modifications may be effective. Descriptions and details of well known components and techniques have not been described above where they have not been deemed to be essential to the understanding of the present invention.

The invention claimed is:

1. An electromagnetic switch comprising a guiding medium and switch means for controlling propagation within the guiding medium, characterised in that the guiding medium is a parallel plate or an electromagnetic band gap structure, and the switch means comprises an array of electromagnetic switch elements positioned either in control spaces within the parallel plate structure or in holes in a ground plane of the electromagnetic band gap structure to allow selective reflection and absorption of an electromagnetic signal in controlled directions.

2. An active electromagnetic antenna including at least one electromagnetic switch according to claim 1.

3. An active electromagnetic delay line including at least one electromagnetic switch according to claim 1.

4. An electromagnetic switch according to claim 1 in which the guiding medium is made of a semi-conductor material.

5. An electromagnetic switch according to claim 1 in which the electromagnetic switch elements are activated by displacement of transmissive, absorptive and reflective elements of desired complex permittivities, where the complex permittivity of each said element determines its ability to transmit, reflect and absorb power, with the displacement being electrostatic displacement, electric field displacement, magnetic field displacement, or thermal displacement.

6. An electromagnetic switch according to claim 1 in which the elements are in the form of polymers, powders or liquid suspensions of complex permittivities for achieving selectable transmission, reflection and absorption.

7. An electromagnetic switch according to claim 1 in which the parallel plate structure is a microwave parallel plate structure; and includes at least one element of controllable permittivity that may be used to affect the two dimensional spatial distribution of the electromagnetic energy by absorption of energy.

8. An electromagnetic switch according to claim 1 in which the electromagnetic switch elements have complex permittivities which are controllable through associated logic devices.

* * * * *